US006861994B2

(12) United States Patent
Desargant et al.

(10) Patent No.: US 6,861,994 B2
(45) Date of Patent: Mar. 1, 2005

(54) METHOD AND APPARATUS FOR MOUNTING A ROTATING REFLECTOR ANTENNA TO MINIMIZE SWEPT ARC

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 09/965,668

(22) Filed: Sep. 27, 2001

(65) Prior Publication Data

US 2003/0058179 A1 Mar. 27, 2003

(51) Int. Cl.[7] ..... H01Q 1/28; H01Q 3/08
(52) U.S. Cl. ..... 343/765; 343/705; 343/766
(58) Field of Search ..... 343/708, 765, 343/766, 705, 756

(56) References Cited

U.S. PATENT DOCUMENTS

| | | | | |
|---|---|---|---|---|
| 2,421,593 A | | 6/1947 | Bishop | 343/792 |
| 2,427,005 A | | 9/1947 | King | 343/761 |
| 3,860,930 A | * | 1/1975 | Peterson | |
| 4,635,067 A | * | 1/1987 | Fitzpatrick | 343/705 |
| 4,831,384 A | * | 5/1989 | Sefton | 343/756 |
| 5,398,035 A | * | 3/1995 | Densmore et al. | 343/840 |
| 5,517,204 A | | 5/1996 | Murakoshi et al. | |
| 5,835,057 A | | 11/1998 | van Heyningen | 342/359 |
| 6,034,643 A | | 3/2000 | Nishikawa et al. | |
| 6,204,823 B1 | * | 3/2001 | Spano et al. | 343/705 |
| 6,218,999 B1 | | 4/2001 | Bousquet et al. | |

OTHER PUBLICATIONS

A Satellite–Tracking K– and Ka–Band Mobile Vehicle Antenna System dated Nov. 1993, Authors Arthur C. Densmore and Vahraz Jamnejad, 9 pages.
International Search Report for PCT/US 02/ 28740, 4 pages.

* cited by examiner

*Primary Examiner*—Michael C. Wimer
(74) *Attorney, Agent, or Firm*—Harness Dickey & Pierce P.L.C.

(57) ABSTRACT

An apparatus and method for mounting a reflector antenna system on an outer surface of an aircraft which minimizes a swept arc of a main reflector. This allows the effective frontal area of the main reflector to be reduced such that a radome with a smaller frontal area can be employed to cover the antenna system. The preferred embodiments make use of a platform which rotates the main reflector about an azimuthal axis which is disposed forwardly of an axial center of the main reflector. In one embodiment, the azimuthal axis is located in a plane extending between the outermost lateral edges of the main reflector. In another embodiment the azimuthal axis is located forwardly of the outermost lateral edges of the main reflector.

11 Claims, 3 Drawing Sheets

FIG 1
PRIOR ART
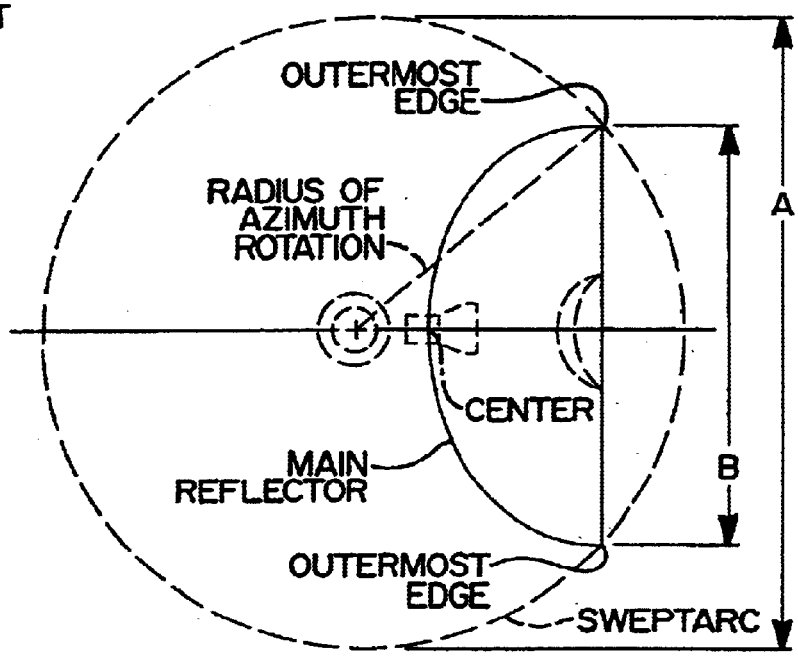
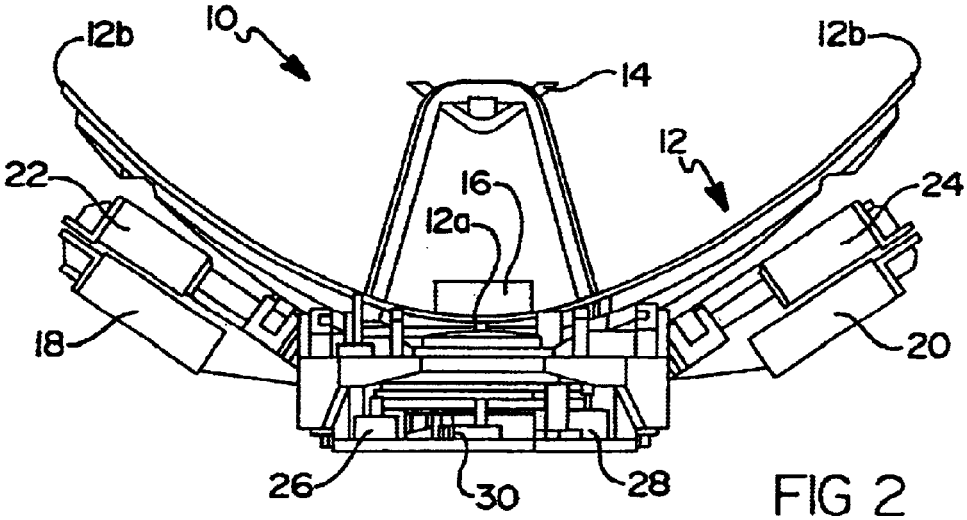
FIG 2

FIG 5
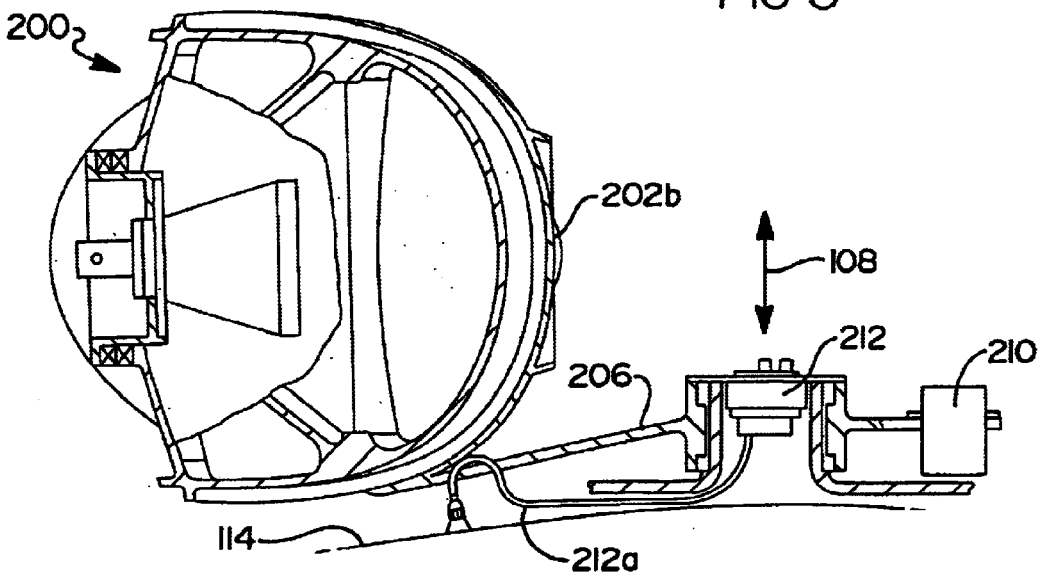
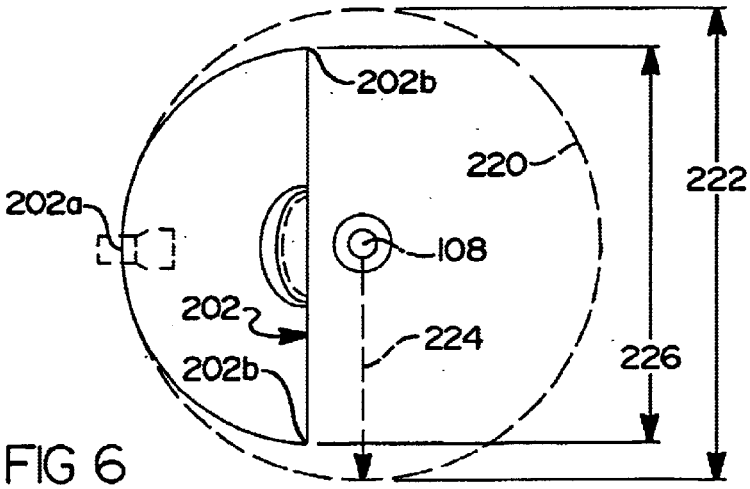
FIG 6

METHOD AND APPARATUS FOR MOUNTING A ROTATING REFLECTOR ANTENNA TO MINIMIZE SWEPT ARC

FIELD OF THE INVENTION

The present invention relates to antenna systems, and more particularly to a method and apparatus for mounting a reflector antenna in such a manner as to minimize the swept arc of the antenna when the antenna is rotated about its azimuthal axis.

BACKGROUND OF THE INVENTION

The frontal surface area of an antenna mounted on an aircraft, under a radome, is of critical importance with respect to the aerodynamics of the aircraft. This is because of the drag created by the radome and the resulting effects on aircraft performance and fuel consumption. With reflector antennas that must be rotated about their azimuthal axes, the "swept arc" of the antenna is larger than the overall width of the main reflector of the antenna. This necessitates a commensurately wide radome, thus increasing the frontal surface area of the radome and consequently increasing the drag on the aircraft.

Referring to FIG. 1, the diameter of a swept arc "A" of a main reflector of a prior art antenna system can be seen when the azimuthal axis of rotation is located rearwardly, or behind, an axial center of the main reflector, as is conventional with present day reflector antenna systems. The outermost edges of the main reflector are also noted. This diameter is noted by dimension "B". The diameter of the swept arc produced by the main reflector is considerably larger than the diameter of the main reflector itself when the azimuthal axis of rotation is located at, or rearwardly of, the center of the main reflector.

It is therefore extremely important that the height and width of a reflector antenna be held to the minimum dimensions consistent with the required electromagnetic performance of the antenna. More particularly, it is important for the main reflector of an antenna intended to be mounted on an outer surface of an aircraft, to be mounted in such a manner that the swept arc of the antenna is minimized when the antenna is rotated about its azimuthal axis. Minimizing the swept arc of the antenna would thus minimize the dimensions of the radome required to cover the antenna, and thereby minimize the corresponding drag created by the radome while an aircraft on which the radome is mounted is in flight.

SUMMARY OF THE INVENTION

The above drawbacks are addressed by an antenna system and a method for mounting the antenna system in accordance with a preferred embodiment of the present invention. The antenna system generally comprises a main reflector which is mounted on a mounting platform. The mounting platform is rotatable about an azimuthal axis to allow the azimuth angle of the antenna to be adjusted as needed. An azimuth motor is used for rotating the platform as needed to aim the main reflector in accordance with the desired azimuth angle.

A principal feature of the present invention is that the azimuthal axis about which the main reflector is rotated is disposed forwardly of the center of the main reflector, rather than at, or rearwardly of, the center of the main reflector. In one preferred form, the azimuthal axis is located at a point within a plane extending between the outermost ends of the main reflector. In another preferred embodiment, the azimuthal axis is located forwardly of the outer ends of the main reflector. With either arrangement, the swept arc of the main reflector is reduced from that which would otherwise be produced if the azimuthal axis was located coincident with the center of the main reflector, or rearwardly of the center of the main reflector. The maximum reduction in swept arc is provided by locating the azimuthal axis within the plane extending between the outermost ends of the main reflector.

By supporting the main reflector of the antenna at a position laterally offset (i.e., rearwardly) of the azimuthal axis about which the mounting platform is rotated, the swept arc of the antenna is reduced significantly, thereby decreasing the frontal surface area of a radome needed to house the antenna system when the system is mounted on an exterior surface of an aircraft. This mounting arrangement does not significantly complicate the assembly or construction of the antenna system itself or otherwise require significant modifications to the outer body surface of an aircraft on which the antenna system is to be mounted.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a simplified diagram of the swept arc produced by a prior art mounting arrangement wherein the azimuthal axis of rotation of the main reflector is disposed slightly rearwardly of the center of the main reflector;

FIG. 2 is a plan view of a prior art reflector antenna, wherein the main reflector of the antenna has center outermost edge portions.

FIG. 5 is a side view of the antenna system of the present invention located with the azimuthal axis disposed in a plane located forwardly of the outermost edges of the main reflector of the antenna system; and FIG. 6 is a diagram of the swept arc produced by the antenna system shown in FIG. 5.

DETAILED DESCRIPTION OF THE PREFERRED EMBODIMENTS

Figure 3:
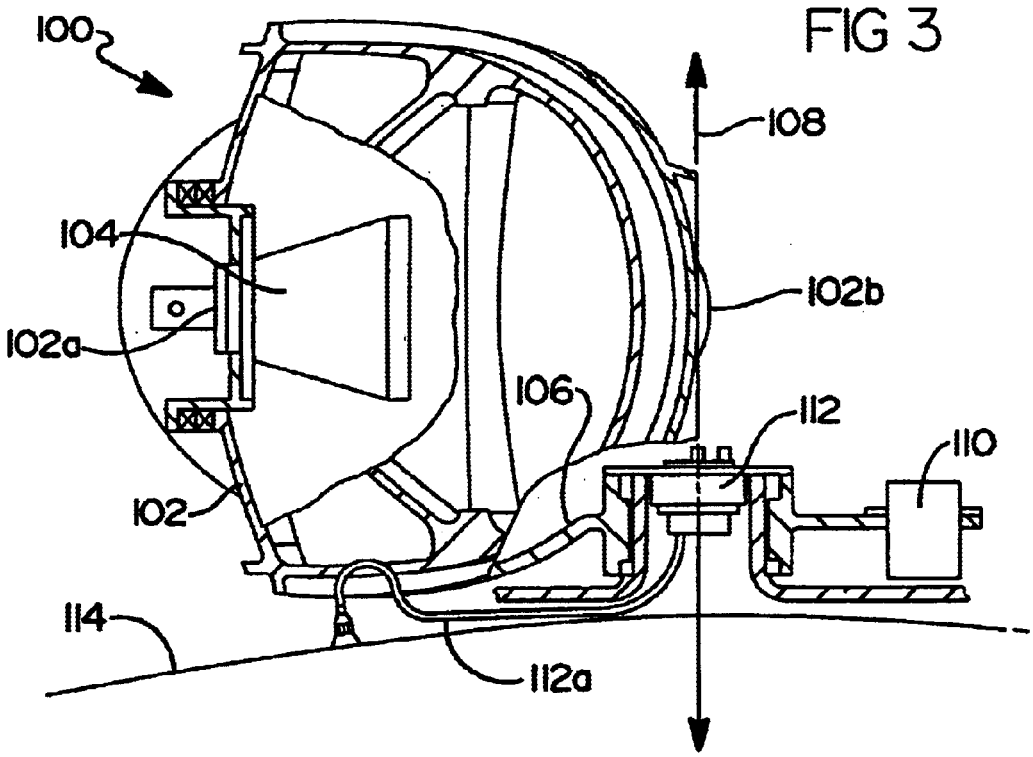
FIG. 3 is a side view of an antenna system in accordance with a preferred embodiment of the present invention illustrating the azimuthal axis located within a plane extending between the outermost edges of the main reflector of the antenna.

The following description of the preferred embodiment(s) is merely exemplary in nature and is in no way intended to limit the invention, its application, or uses.

Referring to FIG. 2, a prior art antenna system 10 well suited to be mounted on an external surface of an aircraft is shown. The antenna system 10 includes a main reflector 12 having a center 12*a* and outermost edge portions 12*b*. A subreflector 14 is positioned forwardly of a feedhorn 16 located at the center 12*a* of the main reflector 12. A pair of low noise amplifiers (LNA) 18 and 20 are used, as are a pair of diplexers 22 and 24, for performing signal conditioning operations on the received and transmitted signals. An elevation motor 26 is used to position the main reflector 12 at a desired elevation angle, while an azimuth motor 28 is used to rotate the main reflector 12 about an azimuthal axis to position the main reflector at a desired azimuth angle. An encoder 30 is used to track the azimuth angle of the main reflector 12 and to provide feedback to the azimuth motor 28.

Referring now to FIG. 3, an antenna system 100 in accordance with a preferred embodiment of the present invention is illustrated. The antenna system 100 is similar to antenna system 10 by the use of a main reflector 102 having an axial center 102*a* and outermost lateral edge portions 102*b*. A feedhorn 104 is disposed at the center 102*a* of the main reflector 102. The main reflector 102 is supported on a platform 106 which places the azimuth axis of rotation 108 of the main reflector 102 in a plane which extends through the outermost edges 102*b* of the main reflector. The platform 106 is rotated about the azimuthal axis of rotation 108 by an azimuth motor 110 to thus position the main reflector 102 at a desired azimuth angle. A two channel coaxial rotary joint 112 is preferably employed to enable the necessary electrical connections between the feedhorn 104 and a transmission line 112*a* which extends through an outer surface 114 of an aircraft. For simplicity, the radome which would ordinarily enclose the entire antenna system 100 has not been shown.

Figure 4:
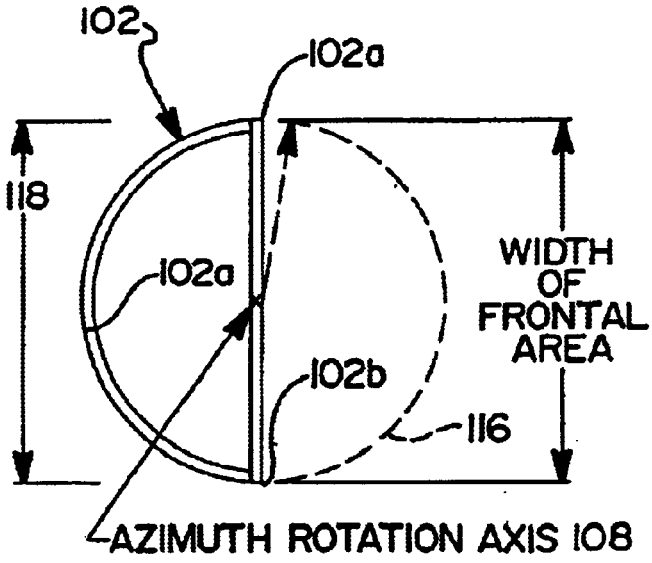
FIG. 4 is a diagram illustrating the swept arc produced by locating the azimuthal axis of rotation as shown in FIG. 3.

Referring to FIG. 4, a swept arc 116 is shown which is produced by rotational movement of the main reflector 102, shown in highly simplified form, of the antenna system 100. When the azimuthal axis of rotation 108 is located such that it extends through the outermost lateral edges 102*b* of the main reflector 102, as described in connection with FIG. 3, the radius of the swept arc 116 is approximately one-half that of the overall length 118 of the reflector 102. Thus, locating the azimuthal axis of rotation 108 forwardly of the center 102*a* of the main reflector 102 (i.e., to the right of center point 102*a* in FIG. 3) dramatically reduces the swept arc produced by the main reflector. This reduction in the overall area, and volume, of the swept arc is also visible from a comparison of FIGS. 1 and 4.

The antenna system 100 shown in FIG. 3, however, in some applications, may result in an unacceptable degree of blockage of the signal being transmitted and/or received by the antenna system 100. Accordingly, it may be desirable to locate the azimuthal axis of rotation 108 shown in FIG. 3 forwardly of the outermost edges 102*b* of the main reflector 102. Such a mounting arrangement is shown in FIG. 5. Antenna system 200 shown in FIG. 5 is identical with antenna system 100 shown in FIG. 3 with the exception that mounting platform 206 has a longer overall length to allow the azimuthal axis or rotation 108 to be located forwardly (i.e., to the right in FIG. 5) of the outermost edges 202*b* of the main reflector 202. It will also be appreciated that components of the antenna system 200 in common with those of antenna system 100 have been designated by reference numerals increased by a factor of 100 over those used to denote the components of the antenna system 100, such as motor 210 and transmission line 212*a*. The swept arc produced by the antenna system 200 is shown in FIG. 6. The swept arc is designated by dashed circle 220. The maximum, effective frontal width of the main reflector 202 is thus represented by arrow 222, which is only slightly larger than a diameter 226 of the main reflector. The radius of rotation of the reflector 202 is represented by line 224. Comparing the swept arc 220 of FIG. 6 with the swept arc 116 illustrated in FIG. 4, it can be seen that the swept arc produced by the mounting arrangement of antenna system 200 is slightly greater than that produced by antenna system 100. However, the location of the azimuthal axis forwardly of the outermost edges 202*b* of the main reflector 202 helps to eliminate a degree of the blockage produced by the mounting platform 206 and the rotary joint 212.

The preferred embodiments of the present invention thus provide a means for supporting a reflector antenna in a manner which minimizes the effective frontal area of the reflector antenna, and thus allows a radome having a smaller frontal area to be employed in covering the antenna when the antenna is located on an outer surface of an aircraft. The preferred embodiments do not significantly complicate the construction of the antenna system nor do they complicate the mounting of the antenna system on the outer surface of an aircraft. Furthermore, the preferred embodiments do not significantly add to the costs of construction of the antenna systems.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for mounting a rotatable reflector antenna having a main reflector with outermost side portions and an axial center, to reduce a radius of a swept arc of said main reflector as said main reflector is rotated about an azimuthal axis of rotation, said method comprising the steps of:

supporting said main reflector on a platform;

using a motor to rotate said platform about said azimuthal axis of rotation;

using an encoder to track said azimuthal axis of rotation and provide feedback to said motor; and locating said main reflector on said platform such that said azimuthal axis of rotation is disposed forwardly of a plane extending perpendicularly through said axial center of said main reflector;

wherein said main reflector is fixedly supported relative to said platform such that said main reflector rotates about said azimuthal axis of rotation; and wherein said azimuthal axis is maintained at a constant position at said outermost side portions of said main reflector at all times during azimuthal rotation of said main reflector.

2. The method of claim 1, further comprising the step of using an elevation motor to position said main reflector at a predetermined elevation angle.

3. A method for mounting a rotatable reflector antenna having a main reflector with an axial center, on a mobile platform, in a manner which reduces a radius of a swept arc of said main reflector as said main reflector is rotated about an azimuthal axis of rotation, said method comprising the steps of:

supporting said main reflector on a member adjacent an outer skin of said mobile platform;

using a motor to rotate said member, and thereby said main reflector, about said azimuthal axis of rotation;

using an encoder to track said azimuthal axis of rotation and provide feedback to said motor; and locating said azimuthal axis of rotation at an outermost edge of said main reflector that defines an aperture of the main reflector, wherein the aperture defines a plane extending perpendicular to said axial center of said main reflector;

wherein said main reflector is fixedly supported relative to said platform such that said main reflector rotates about said azimuthal axis of rotation; and wherein said azimuthal axis is maintained at a constant position at said outermost edge of the aperture at all times during rotation of said main reflector.

4. The method of claim 3, further comprising the step of using an elevation motor to position said main reflector at a predetermined elevation angle.

5. A method for mounting a rotatable reflector antenna having a curved main reflector and an axial center, to reduce a radius of a swept arc of said main reflector as said main reflector is rotated about an azimuthal axis of rotation, said method comprising the steps of:

supporting said main reflector on a platform;

using a motor to rotate said platform about said azimuthal axis, of rotation; using an encoder to track said azimuthal axis of rotation and provide feedback to said motor; and locating said main reflector on said platform such that said azimuthal axis of rotation of said platform is forwardly of said axial center of said main reflector;

wherein said main reflector is fixedly supported relative to said platform such that said main reflector rotates about said azimuthal axis of rotation; and wherein said azimuthal axis is maintained at a constant position at an outermost edge of said main reflector at all times during azimuthal rotation of said main reflector.

6. The method of claim 5, wherein said step of supporting said main reflector further comprises the step of supporting said platform adjacent an outer surface of an aircraft.

7. The method of claim 5, wherein said step of supporting said main reflector further comprises the step of using an elevation motor to position said main reflector at a predetermined elevation angle.

8. An antenna adapted to be rotated about an azimuthal axis of rotation in a manner which reduces the radius of an envelope within which said antenna moves during rotation of said antenna, said antenna comprising:

a curved main reflector having an axial center and outermost lateral side edges;

a platform for supporting said curved main reflector;

a motor for rotating said platform about said azimuthal axis; and an encoder to track said azimuthal axis and provide feedback to said motor;

wherein said main reflector is fixedly supported relative to said platform such that said main reflector rotates about said azimuthal axis of rotation; and wherein said azimuthal axis is maintained at a constant position at an outermost edge of said main reflector at all times during azimuthal rotation of said main reflector.

9. The antenna of claim 8, wherein said antenna includes a feedhorn spaced apart from said curved main reflector;

and said platform couples said feedhorn to a transmission line using a rotary joint.

10. The antenna of claim 9, wherein said transmission line comprises a coaxial cable.

11. The method of claim 8, further comprising an elevation motor for positioning said main reflector at a predetermined elevation angle.

* * * * *